US005094637A

United States Patent [19]

Nakamura

[11] Patent Number: 5,094,637

[45] Date of Patent: Mar. 10, 1992

[54] TRIM DETECTING DEVICE FOR MARINE PROPULSION DEVICE

[75] Inventor: Kazuhiro Nakamura, Hamamatsu, Japan

[73] Assignee: Sanshin Kogyo Kabushiki Kaisha, Hamamatsu, Japan

[21] Appl. No.: 507,967

[22] Filed: Apr. 11, 1990

[30] Foreign Application Priority Data

Apr. 14, 1989 [JP] Japan ..... 1-93053

[51] Int. Cl.[5] ..... B63H 21/26

[52] U.S. Cl. ..... 440/1; 440/2

[58] Field of Search ..... 440/1, 2, 61

[56] References Cited

U.S. PATENT DOCUMENTS

| | | | |
|---|---|---|---|
| 3,894,250 | 7/1975 | Hager et al. | 440/1 |
| 4,734,065 | 3/1988 | Nakahama et al. | 440/1 |
| 4,778,414 | 10/1988 | Taguchi | 440/61 |
| 4,861,291 | 8/1989 | Koike | 440/1 |
| 4,865,568 | 9/1989 | Koike | 440/2 |

*Primary Examiner*—Sherman D. Basinger
*Assistant Examiner*—Thomas J. Brahan
*Attorney, Agent, or Firm*—Ernest A. Beutler

[57] ABSTRACT

A trim position sensor and indicator and control unit for a marine outboard drive each of which is provided with its own power supply. The trim position indicator may also control the control circuit to control a watercraft running condition in the event a trim angle change dictates such an adjustment.

2 Claims, 4 Drawing Sheets

TRIM DETECTING DEVICE FOR MARINE PROPULSION DEVICE

BACKGROUND OF THE INVENTION

This invention relates to a trim detecting device for a marine propulsion device and more particularly to a combined trim detecting unit and control unit, each of which has its own power supply.

In marine propulsion units, as is well known, the outboard portion of the marine drive is frequently supported for adjustment through a plurality of trim positions. It is frequently the practice to employ a trim position indicator and detector for detecting the adjusted trim angle and providing an indication of the trim angle to the operator. Frequently, the trim position signal is also employed in a control circuit wherein various components of the marine propulsion unit may be controlled in response to trim angle. For example, it has recently been realized that the running of the power unit of an outboard motor may be effected by the trim position. Therefore, it has been proposed to provide some form of control unit which operates so as to adjust the engine so as to maintain stable running during trim adjustment. In addition, the trim unit itself may be controlled by a control unit.

Where there are such control units that are controlled by the trim detection signal, it is normally the practice to employ the control unit as the power supply for the trim detector and its associated indicator. Of course, this provides certain difficulties in that poor connections or the like may result in improper or failed trim position signals.

It is the object of this invention to provide a control unit and a trim detector, both of which are interrelated and each of which has its own power supply with possibility of the power supply for one unit providing alternate power to the other in the event its own power supply fails.

SUMMARY OF THE INVENTION

This invention is adapted to be embodied in an outboard drive supported on the transom of a watercraft for trim adjustment. An electrically operated trim position sensor provides an output signal indicative of the trim condition of the outboard drive. A trim position indicator is provided for receiving the output signal and providing a display indicative of trim condition. The unit also includes a control circuit for controlling a condition of the watercraft. The control circuit includes means for effecting the control in response to a sensed trim condition. A first electrical power supply is provided for supplying electrical power to the trim position sensor and its display. A second power supply is provided for providing electrical power to the control unit.

DETAILED DESCRIPTION OF THE PREFERRED EMBODIMENTS OF THE INVENTION

Figure 1:
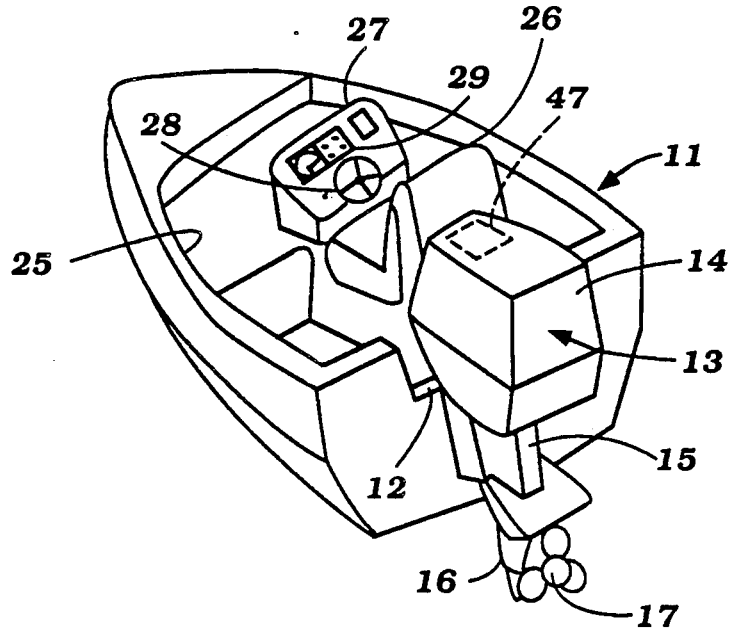
FIG. 1 is a rear perspective view of a watercraft having a trim detecting device constructed in accordance with an embodiment of the invention.
Figure 2:
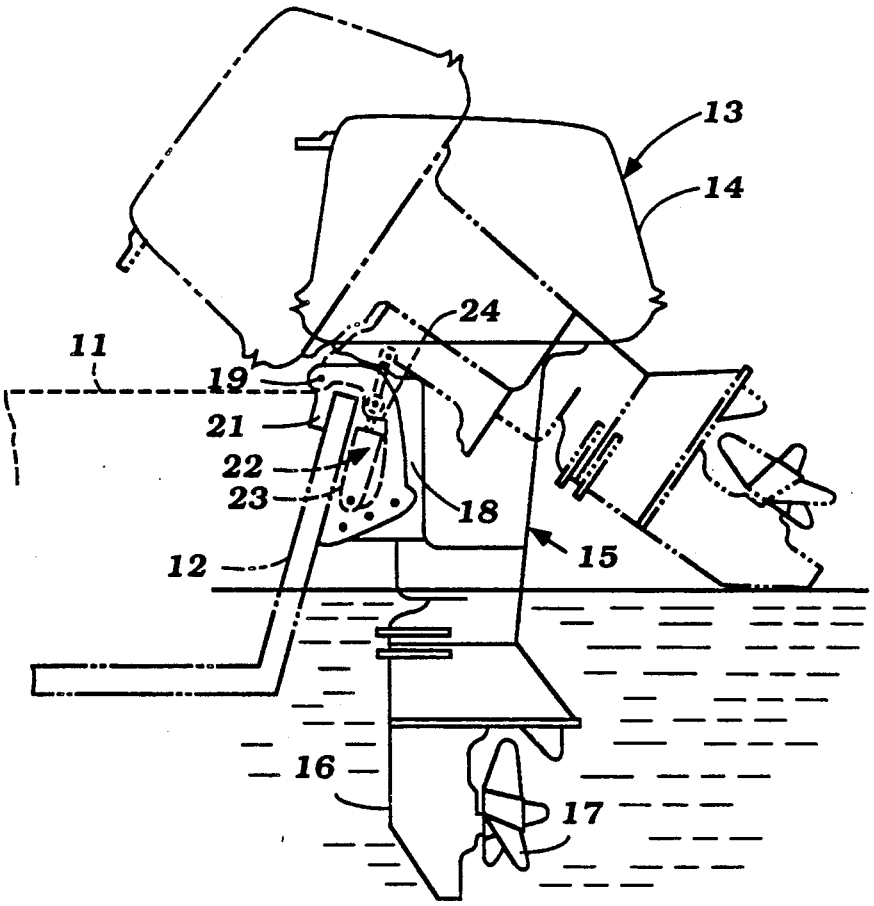
FIG. 2 is a side elevational view of the outboard motor of this unit and its relation to the associated transom of the watercraft.

Referring in detail to the drawings and initially to FIGS. 1 and 2, a watercraft embodying a trim detecting device and control unit constructed in accordance with an embodiment of the invention is identified generally by the reference numeral 11. The watercraft 11 is comprised of a hull having a transom 12 to which an outboard motor 13 is attached in a manner as will be described.

The invention is described in conjunction with a watercraft powered by an outboard motor. It is to be understood, however, that the invention can be utilized also with watercraft propelled by outboard drive portion of an inboard/outboard drive. For that reason, the term "outboard drive unit" is used herein generically to described either an outboard motor per se or the outboard drive unit of an inboard/outboard drive. The important feature of the invention is not the form of the power unit but rather that it is suspended on the transom 12 of the watercraft 11 for trim adjustment, as will be described.

The outboard motor 13 includes a power head 14 which is comprised of an internal combustion engine of any known type and a surrounding protective cowling. The engine drives a drive shaft (not shown) that is journaled within a drive shaft housing 15 and which depends into a lower unit 16 for driving a propulsion device such as a propeller 17 in selected forward or reverse direction.

A steering shaft (not shown) is affixed to the drive shaft housing 15 and is journaled within a swivel bracket 18 for steering of the outboard motor 13 and associated watercraft in a manner well known in this art. The swivel bracket 18 is, in turn, pivotally connected by means of a pivot pin 19 to a clamping bracket 21 that is affixed to the transom 12 in a known manner. Pivotal movement about the pivot pin 19 effects trim and tilt adjustment of the outboard motor 13.

This tilt and trim movement is accomplished by means of a hydraulic motor assembly, indicated generally by the reference numeral 22. The hydraulic motor assembly 22 includes a cylinder 23 that has a pivotal connection to the clamping bracket 21 and a piston (not shown) that is attached to a piston rod 24 which has a pivotal connection to the swivel bracket 18. Operation of the hydraulic motor assembly 22 will cause the outboard motor 13 to pivot from a fully trimmed down position as shown in solid lines in FIG. 2 through a plurality of trim adjusted positions to a tilted up out of the water position as shown in phantom lines.

The watercraft 11 is provided with a rider or passenger's compartment 25 in which seats including an operator seat 26 are positioned. A bridge 27 is positioned ahead of the operator seat 26 and contains both instruments and controls for operating the watercraft 11. These include a steering wheel 28 that is coupled to the outboard motor 13 for effecting its steering operation. In addition, a trim indicator 29 is positioned ahead of the operator's seat 26 and displays to the operator information regarding the trim adjusted position of the outboard motor 13. A suitable control (not shown) may be provided for permitting the operator to adjust the trim and tilt operation of the outboard motor 13 by operating the fluid motor 22 in any of the known manners.

Figure 3:
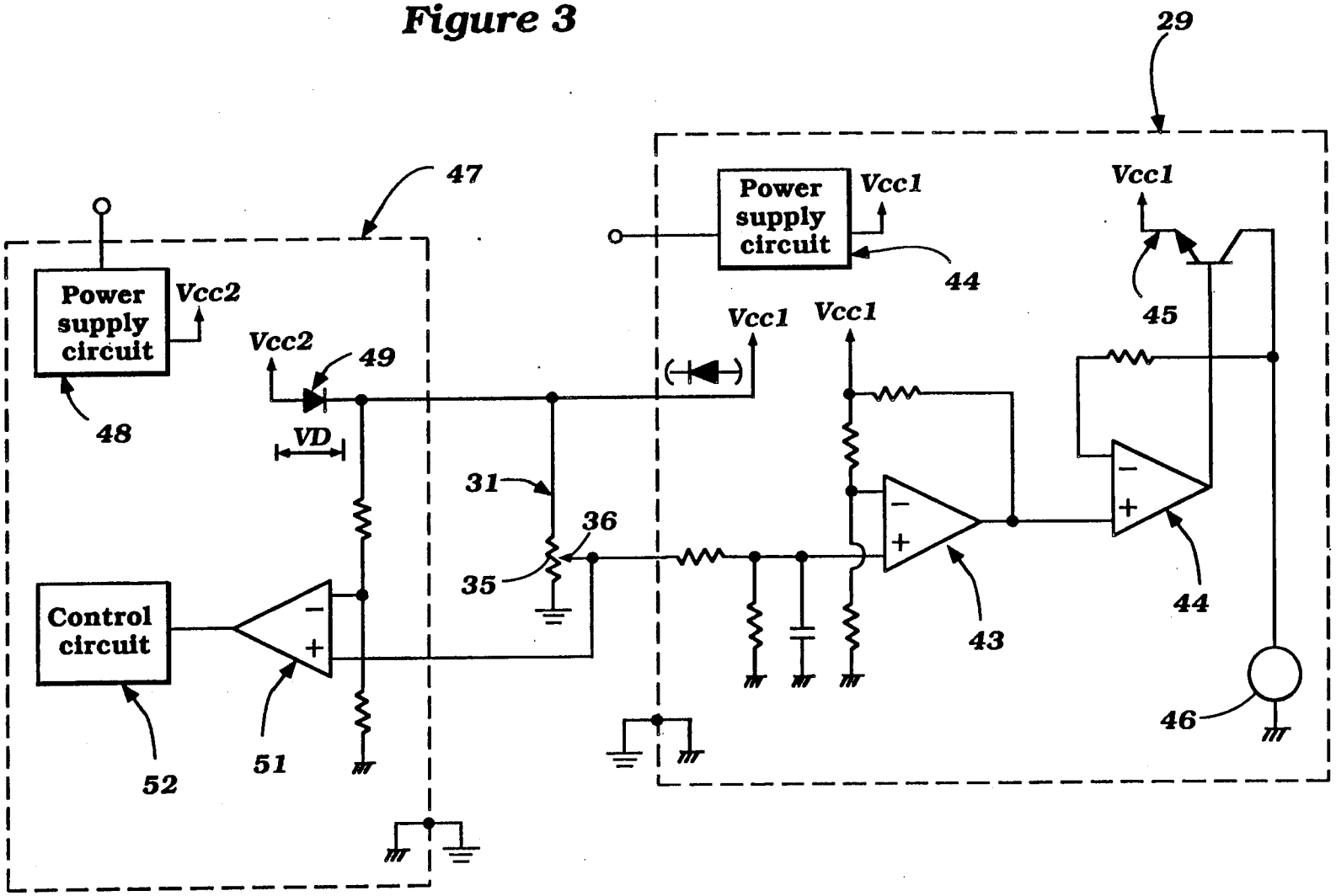
FIG. 3 is a schematic electrical diagram of this embodiment of the invention.
Figure 4:
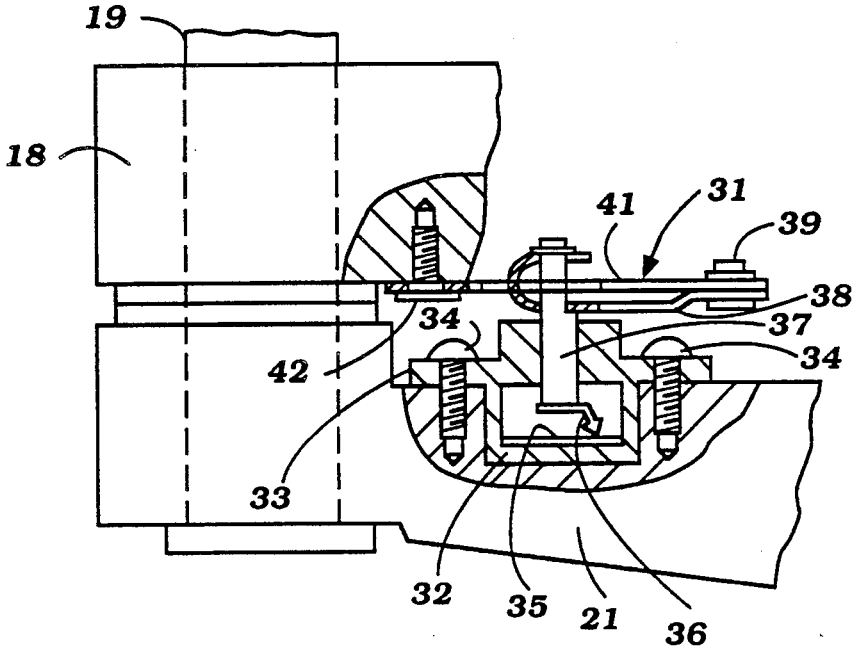
FIG. 4 is a top plan view, with a portion broken away, showing the construction of the trim detector.
Figure 5:
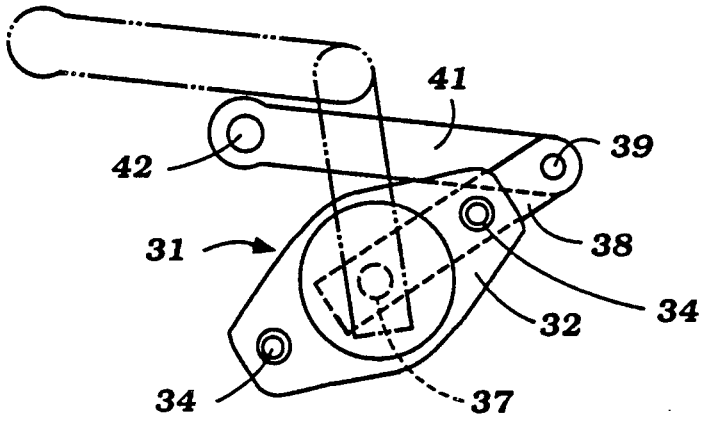
FIG. 5 is a side elevational view of the trim detector with one extreme position being shown in solid lines and another extreme position being shown in phantom.

Referring now in detail to FIGS. 4 and 5, the trim indicator 29 is associated with a trim sensor, indicated generally by the reference numeral 31 and which is mounted as a unit with the outboard motor 13. The trim sensor 31 includes a main housing assembly 32 that has a generally cup shape and which has a flange portion 33 that is provided with a pair of openings so as to pass threaded fasteners 34 for affixing the body 32 to the clamping bracket 21. A resistance element 35 is provided within the body 32 and is contacted by a wiper 36. The wiper 36 is, in turn, affixed to a shaft 37 that is journaled within the flange 33 of the main body 32. As a result, rotational movement of the shaft 37 and wiper 36 will provide a variable resistance output as may be seen in FIG. 3.

The shaft 37 has affixed to it one end of a first lever 38. The opposite end of the first lever 38 is connected by means of a pivot pin 39 to one end of a second lever 41. The second lever 41 has its opposite end connected to the swivel bracket 18 by means of a threaded fastener 42. As a result of the aforedescribed construction, as the swivel bracket 18 pivots relative to the clamping bracket 21, the shaft 37 will be rotated from the solid line position as shown in FIG. 5 to the phantom line position as shown in this figure. This will change the resistance of the device 31 and will output a variable signal to a amplifier circuit 43 of the indicator mechanism 29. The indicator mechanism 29 is provided with its own power supply 44 that is in circuit with the battery (not shown) and which outputs a constant voltage signal Vcc1 to a series of terminals including a terminal that supplies electrical power to the resistance winding 35 so as to provide the aforenoted outputted signal.

The amplifier circuit 43 outputs its signal to a drive circuit 44 which operates a transistor 45 so as to energize the motor 46 that drives the needle of the display 29. As a result, the indicator 29 will provide an indication in analog form of the angle of the outboard motor 13 about the pivot pin 19.

As described in the copending application entitled "Ignition Timing Control System For Outboard Engine", Ser. No. 325,294, filed Mar. 17, 1989, and assigned to the assignee of this application, the trim adjustment of the outboard motor 13 can adversely effect its running if more than a predetermined trim condition exists. As described in that application, in that event, there is provided a change in the spark advance of the ignition circuit, which is indicated schematically in the drawings of this application at 47 so as to change the spark timing. The spark control circuit 47 includes its own power supply 48 which also receives power from the battery and which outputs it to a series of terminals Vcc2 including a driver circuit 49 for supplying a fixed reference signal VD to one terminal of a comparator 51. The comparator 51 also receives a signal from the trim angle sensor 31, and when the angle change is greater than a predetermined amount, will output a signal to a control circuit 52 which alters the spark timing as described in aforenoted application Ser. No. 325,294.

As will be noted, the power supply 48 is in circuit with the trim sensing device 31 so that the trim sensing device 31 will receive power from either the power supply circuit 44 or the power supply circuit 48. This provides additional insurance that the device will be absolutely foolproof in operation and any bad connection will not result in adverse readings. In the embodiment of the invention as thus far illustrated and described, the circuits have been analog circuits and the display has been an analog display.

Figure 6:
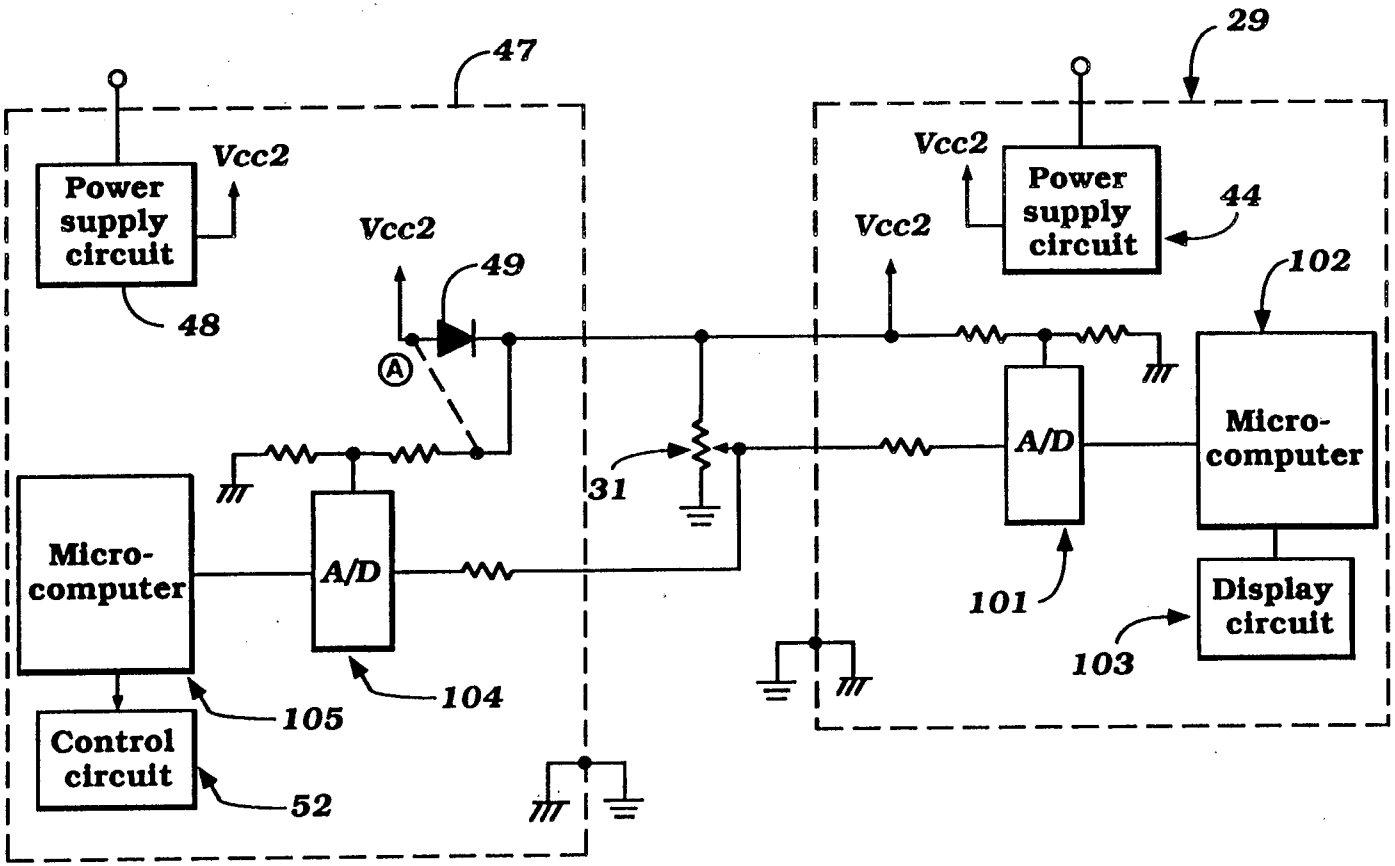
FIG. 6 is a schematic electrical diagram, in part similar to FIG. 3, showing another embodiment of the invention.

FIG. 6 shown another embodiment of the invention which is generally the same and, for that reason, components which are the same are identified by the same reference numerals. In this embodiment, the sensing device 31 outputs its signal to an analog to digital converter 101 which outputs a digital signal to a microcomputer 102 which, in turn, drives the display circuit 103 so as to provide a digital display.

In a similar manner, the junction Vcc2 supplies a reference voltage to an analog to digital converter 104 of the ignition control circuit 47 which also processes the signal from the trim angle sensor 31 and outputs a signal to a microcomputer 105 which will control the spark control circuit 52 in the event that the trim angle is changed sufficiently so as to require a change in spark advance to avoid uneven engine running. Again, alternate power supplies are provided for the trim angle display 29 either from the power supply 44 of its own circuit or the power supply 48 of the control circuit 47.

The foregoing description obviously provides two embodiments of the invention that are effective in insuring that the trim angle will be accurately displayed since the trim angle sensing device and display has its own power supply. In addition, backup is provided by the power from the control circuit, although this power need not be necessarily supplied due to the aforenoted independent power supply. Although two embodiments of the invention are illustrated and described, various changes and modifications may be made without departing from the spirit and scope of the invention, as defined by the appended claims.

I claim:

1. In an outboard drive supported on the transom of a watercraft for trim adjustment, an electrically operated trim position sensor for providing an output signal indicative of the trim condition of said outboard drive, a trim position indicator for receiving said output signals and providing a display indicative of trim condition, an ignition control circuit for controlling the ignition of the engine of said watercraft, said ignition control circuit including means for effecting control in response to a sensed trim condition, a first constant voltage electrical power supply for supplying electrical power to said trim position sensor and said trim position indicator, said ignition control circuit including a second constant voltage electrical power supply for supplying power to said control circuit, and circuit means for connecting both of said power supplies to supply power to said trim position sensor and trim position indicator.

2. In an outboard drive as set forth in claim 1 wherein the control circuit adjusts the engine timing in the event trim angle condition is likely to cause abnormal engine running.

* * * * *